United States Patent [19]

Holden et al.

[11] 4,062,144

[45] Dec. 13, 1977

[54] FLEXIBLE DOLL HAVING ARM MEMBERS PIVOTABLE TO PLURAL STABLE POSITIONS

[75] Inventors: John E. Holden, Mount Joy, Pa.; Brian S. Prodger, Barrington, R.I.

[73] Assignee: Hasbro Development Corporation, Pawtucket, R.I.

[21] Appl. No.: 679,040

[22] Filed: Apr. 21, 1976

[51] Int. Cl.[2] ..... A63H 3/04

[52] U.S. Cl. ..... 46/151; 16/150; 46/161

[58] Field of Search ..... 46/151, 160, 161, 162, 46/163, 173, 156, 159; 220/339; 16/150

[56] References Cited

U.S. PATENT DOCUMENTS

| | | | |
|---|---|---|---|
| 2,614,365 | 10/1952 | Musselwhite et al. | 46/159 X |
| 3,019,486 | 2/1962 | Stinson | 46/156 |
| 3,053,008 | 9/1962 | Pelunis | 46/161 X |
| 3,284,947 | 11/1966 | Dahl | 46/156 |
| 3,289,877 | 12/1966 | Wolf | 16/150 X |
| 3,325,939 | 6/1967 | Ryan et al. | 46/156 |
| 3,624,691 | 11/1971 | Robson | 46/162 |

FOREIGN PATENT DOCUMENTS

| | | | |
|---|---|---|---|
| 2,346,675 | 3/1975 | Germany | 46/159 |
| 636,968 | 5/1950 | United Kingdom | 46/151 |

*Primary Examiner*—F. Barry Shay
*Attorney, Agent, or Firm*—Salter & Michaelson

[57] ABSTRACT

A doll construction having a relatively flexible body to which leg members and arms are joined, an arm assembly being located in the body adjacent to the upper end thereof and extending outwardly of the body into the arms to define therewith arms members, the arm assembly including a plurality of hingedly connected segments that are movable from a fully opened to a fully closed position. The body, leg members and arms may be made of a flexible cover member which may have foamed material therein. The arm assembly may be of polypropylene.

7 Claims, 9 Drawing Figures

FLEXIBLE DOLL HAVING ARM MEMBERS PIVOTABLE TO PLURAL STABLE POSITIONS

BACKGROUND OF THE INVENTION

The present invention relates to a doll construction and to a segmented arm assembly for use therewith that defines arm members that are selectively movable from a fully opened to a fully closed position.

The prior known doll constructions that employed limbs that were movable to different positions usually included some form of a spring element for accomplishing the purpose of moving the limbs from an opened to a closed position. Examples of the prior art doll units employing springs for this purpose are illustrated in U.S. Pat. Nos. 2,614,365 and 3,053,008. The doll constructions as illustrated and described in these prior patents included limbs, such as arms, that were provided with some form of a metallic spring element that enable the arms to move to the prescribed position. U.S. Pat. No. 1,940,608 also disclosed the use of a molded compressible material connected by an elastic member for use in moving arms to a prescribed position in a doll construction. Other prior doll constructions as illustrated in U.S. Pat. Nos. 2,129,421 and 3,624,691 included bendable or spring material incorporated in the arms and legs thereof that enabled these limbs to be moved to various positions.

Although the constructions illustrated in the prior patents accomplish the purpose of providing for movement of the limbs of the doll, the spring elements or plastic material as described, were somewhat limiting in the manner of use thereof and sometimes inhibited the limbs from being moved in a positive manner to a desired position. Further, these prior constructions had a tendency to be fragile and were not capable of withstanding excessive play action as is normally experienced in the use of a doll. A further limiting feature of the prior constructions was that they included materials that were expensive to fabricate and install in an appropriate manner; and, therefore, the cost of the prior known doll constructions as mentioned hereinabove was prohibitive.

SUMMARY OF THE INVENTION

The doll construction of the present invention includes a relatively flexible body to which limbs such as leg members are joined. The arm members of the doll construction are formed in part by an arm assembly located in the body adjacent to the upper end thereof. The arm assembly is defined by a one-piece, plastic strap, the outermost ends of which extend outwardly of the body for encasement in the covering of the doll to form the arm members. The one-piece, plastic strap includes a plurality of hingeable segments that are pivotal to locate the arm members in selected position, the arm members being movable from a fully opened to a fully closed or hugging position.

Accordingly, it is an object of the present invention to provide a doll construction having an arm assembly that includes a plurality of hingeable segments that are selectively pivotal to locate the arm members in various positions of use.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
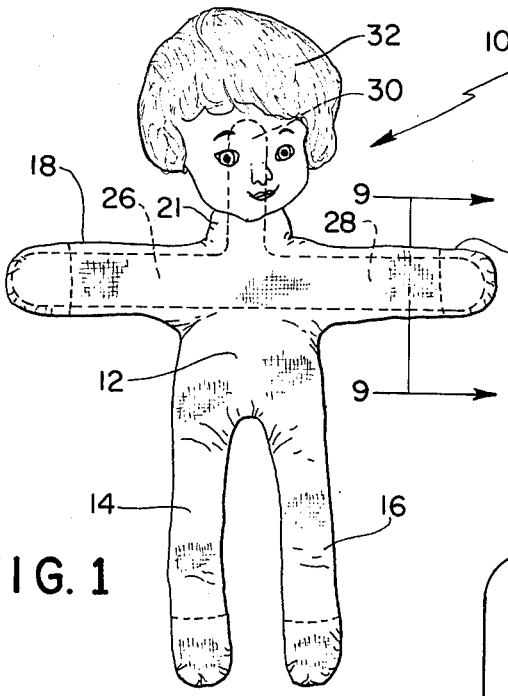
FIG. 1 is a front elevational view of the doll construction embodied in the present invention, the arm assembly as embodied herein being shown in phantom.

Referring now to the drawings and particularly to FIG. 1, the doll construction embodied in the present invention is illustrated and is generally indicated at 10. The doll 10 includes a body 12 to which legs 14 and 16 and arms 18 and 20 are joined. The body 12, legs 14 and 16 and arms 18 and 20 are formed by an outer cover of any suitable cloth material over which a dress or other clothing can be placed as is conventional in doll constructions. A padding of any suitable material is encased within the cover that forms the body 12 and legs 14 and 16 to impart a "soft " feeling thereto. As will be described, the portion of the cover that forms the arms 18 and 20 receives a plastic strap therein that defines an arm assembly, the arm assembly being constructed such that the arms 18 and 20 are movable to various positions from fully opened to fully closed. The cover is also shaped to define a neck section 21 that is located between the arms 18 and 20 and at the upper end of the body 12.

Figure 2:
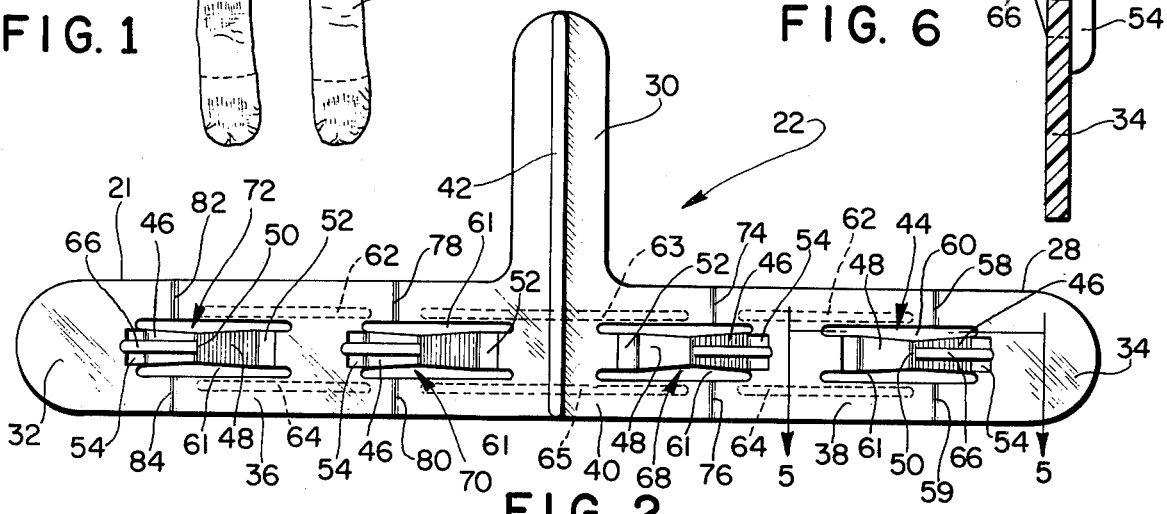
FIG. 2 is a front elevational view of the arm assembly that is located interiorly of the doll construction shown in FIG. 1.

Referring now to FIG. 2, an arm assembly generally indicated at 22 is illustrated; and, as shown in phantom in FIG. 1, the arm assembly 22 is received in the upper portion of the body 12 and extends into the arms 18 and 20 of the cover to form the interior of the arm members of the doll. The arm assembly 22 is defined by an elongated strap of a plastic material and is formed in a one-piece construction that includes oppositely extending portions 26 and 28. As shown in FIG. 1 and as will be further described, the portions 26 and 28 are received in the arms 18 and 20 and cooperate to produce selected movement thereof. An intermediate neck portion 30 is joined to the one-piece strap 24 and extends in perpendicular relation with respect to the longitudinal axis of the strap, the neck portion 30 extending through the neck section 21 of the cover and into a head 32 of the doll. Although the head 32 may be formed as a separate member, it is preferably formed as an extension of the cover and is stuffed with a padding to define the appropriate shape and configuration as illustrated in FIG. 1.

Figure 3:
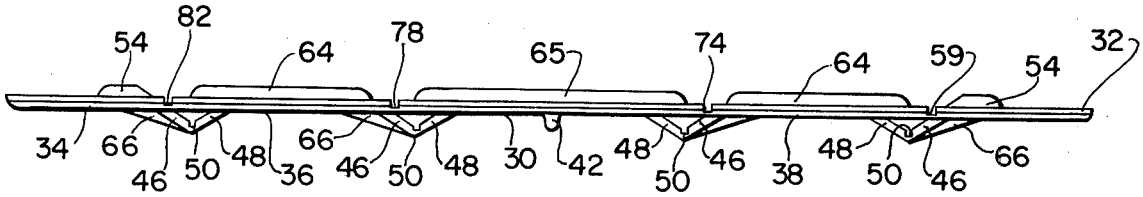
FIG. 3 is a bottom plan view of the arm assembly.
Figure 4:
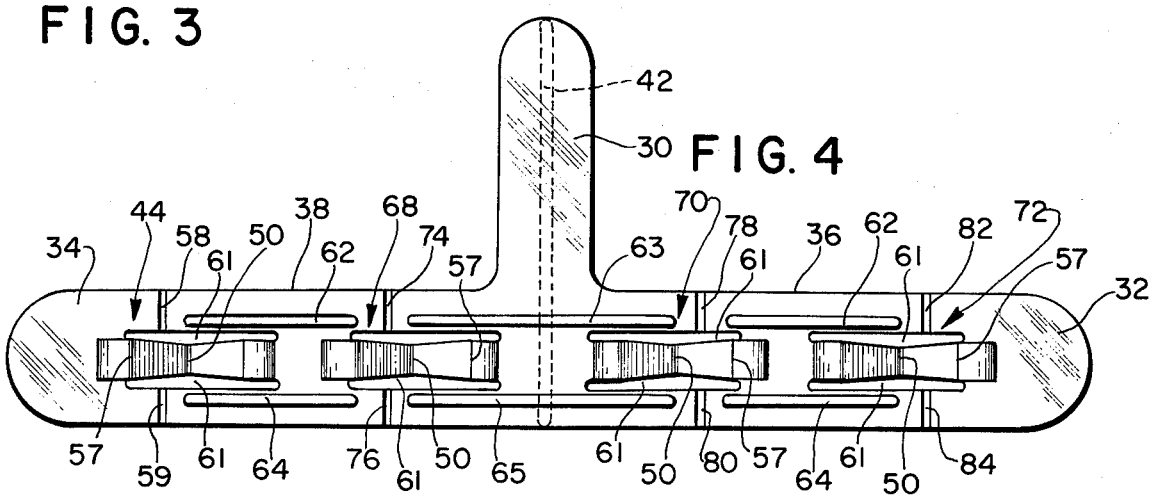
FIG. 4 is a rear elevational view of the arm assembly.

Referring now to FIGS. 2, 3 and 4, the strap or arm assembly in which is molded of a plastic material in a one-piece construction is shown including a plurality of segments that are defined by end segments 32 and 34, intermediate segments 36 and 38 and a central segment 40. Integrally joined to the central segment 40 is the neck portion 30 on which a rib 42 is formed that extends intermediate thereof, the rib 42 strengthening the neck portion 30 and central segment 40 for preventing deflection thereof during movement of the segments 32–38.

Figure 7:
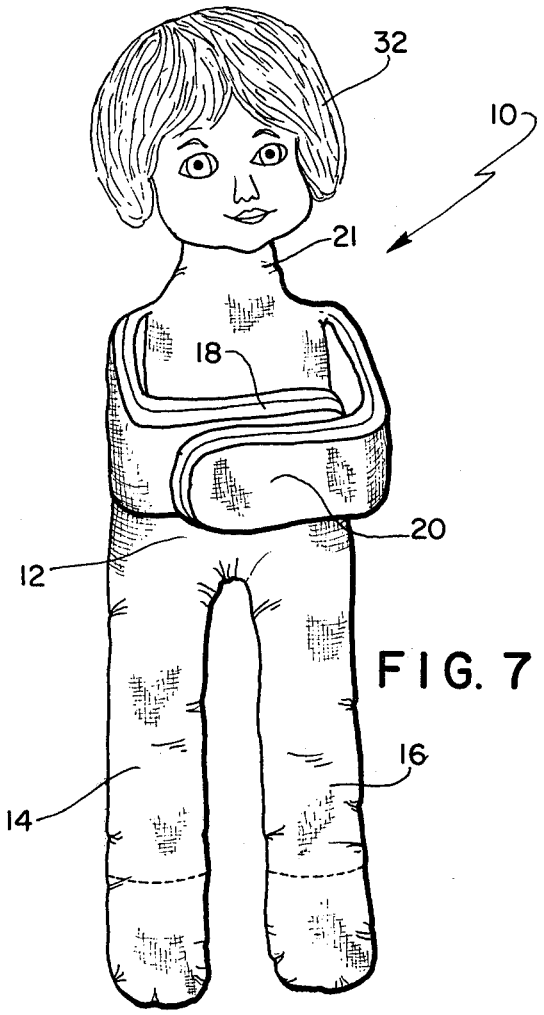
FIG. 7 is a view similar to FIG. 1, but showing the arm assembly of the doll construction in the closed position thereof.
Figure 8:
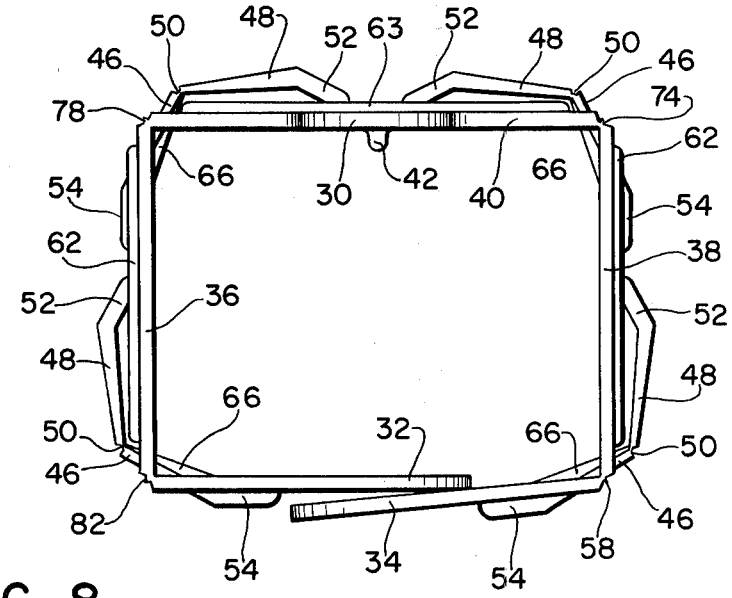
FIG. 8 is a top plan view of the arm assembly showing the segments thereof in the fully closed position.

The segments 32, 34, 36 and 38 are all pivotal with respect to an adjacent segment and provide for movement of the arm members from an opened position as illustrated in FIG. 1 to a closed position as illustrated in FIG. 7. Since the strap portions 26 and 28 of the arm assembly are movable from a fully opened position as illustrated in FIGS. 2 and 4, to a fully closed position as illustrated in FIG. 8, it is seen that the arm members of the doll 10 will appear to fold from the opened or extended position shown in FIG. 1 to a closed or hugging position shown in FIG. 7. In order to provide for the pivotal movement of the various segments, the segments are interconnected by identically formed plastic hinges which provide for an over-center movement of each segment until it is at right angles with respect to an adjacent segment. In this connection and for purposes of illustration, reference is made herein to the hinge for segments 34 and 38, all of the hinges for the segments being identically formed. The segments 34 and 38 are shown interconnected by one of the plastic hinges generally indicated at 44, the hinge 44 including a spring arm 46 and a connecting arm 48. The spring arm 46 is integrally joined to the connecting arm 48 by a hinge connection 50 and is disposed in angular relation thereto, while the connecting arm 48 includes a connecting portion 52 that is joined to the main body of the segment 38 in offset and parallel relation. The spring arm 46 also includes a connecting portion 54 that is joined to the segment 34 in offset and parallel relation. The segments 34 and 38 are hingedly connected to each other along hinge connections 58 and 59, that are separated by the spaces 60 and 61, the spring arm 46 and connecting arm 48. The hinge connections 58,59 are also laterally offset relative to the hinge connection 50, the purpose of which will be described hereinafter. Reinforcing ribs 62 and 64 are formed on one side of the segment 38 and tend to retain the segment 38 in a substantially planar position as the adjacent segment 34 is pivoted relative thereto and as segment 38 is pivoted relative to segment 40. Reinforcing ribs 63 and 65 are also formed on the segment 40 to prevent deflection thereof as the other segments are pivoted. As more clearly illustrated in FIG. 3, the hinge connections 50, 58 and 59 are reduced along the sections thereof in the conventional manner of a plastic hinge, thereby enabling the sections 34 and 38 to easily pivot relative to one another as permitted by the over-center movement of the spring arm 46 and the connecting arm 48. The spring arm 46 is also formed with a reinforcing rib 66 that cooperates with the spring arm 46 in providing for biased movement of the segments 34 and 38 relative to each other.

It is understood that the plastic hinges generally indicated at 68, 70 and 72 are constructed similarly to the hinge 44 and provide for the pivotal interconnection of segments 38 and 40, 36 and 40 and 32 and 36, respectively. In this connection it will be noted that the segments 38 and 40 are separated by the hinge connections 74,76; while segments 36 and 40 are separated by the hinge connections 78, 80, and segments 32 and 36 are separated by the hinge connections 82,84.

Figure 9:
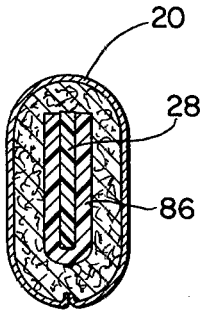
FIG. 9 is a sectional view taken along line 9—9 in FIG. 1.

In the assembly of the arm assembly 22 in the doll construction 10, the segments 32 and 36 are inserted within the arm 18 while the segments 34 and 38 are inserted in the arm 20. As further shown in FIG. 9, a resilient material 86 such as polyurethane foam encases the plastic strap as located in the arms so that the arm members also have a feeling of softness when handled by the user. As further shown in FIG. 1, the segment 40 is located centrally of the doll body, and in the movement of the arm members will remain substantially rigid. The plastic strap that defines the arm assembly 22 is formed of any convenient plastic material; although, polypropylene is preferred, since this material is particularly adaptable for forming plastic hinges as are required for pivotally connecting the segments 32, 34, 36 and 38. As described, the plastic strap that defines the arm assembly 22 is molded in a one-piece construction with the hinge lines molded therein as illustrated and described.

With the arm assembly 22 as defined by the plastic strap located in the body portion of the doll construction shown in FIG. 1, the arm members are disposed in an opened position. In order to locate the arm members in a closed position as shown in FIG. 7, the segments 36 and 38 are pivoted relative to the segment 40, the associated spring arms and connecting portions providing for a snap action movement thereof along their hinge connections to a generally perpendicular position with respect to the adjacent segments 32 and 34, respectively. The segments 32 and 34 are then pivoted along their respective hinge connections to locate these segments at right angles relative to the segments 36 and 38, respectively. In this position each of the segments is located perpendicular to the segment to which it is pivotally joined; and, as shown in FIGS. 7 and 8, the arm members are located in a folded or hugging position.

Figure 5:
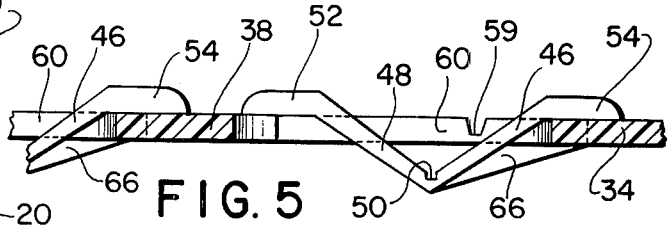
FIG. 5 is a sectional view taken along line 5—5 in FIG. 2.
Figure 6:
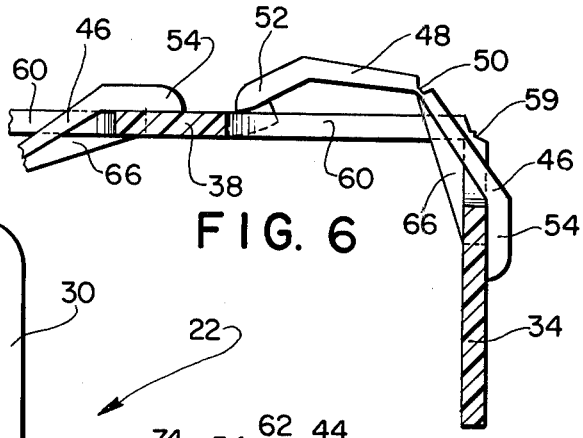
FIG. 6 is a view similar to FIG. 5 and showing one of the segments of the arm assembly after it has been pivotally moved from an open to a closed position.

It is understood that either of the arm members may be moved from the fully open to the fully closed position, or the segments 32 and 34 may be pivotally moved relative to the segment 40 without pivotal movement of the segments 36 and 38. Similarly, the outer segments 32 and 34, or the segments 36 and 38 may be pivoted independently of the other segments as desired by the user. In any event, the segments are movable to a variety of positions, the hinge connections providing for the positive movement thereof from the open to a closed position. It is seen that the spring arm 46 of each segment cooperates with the connecting arm 48 to produce the snap action movement of the segments as they are pivotally moved relative to each other. By locating the hinge connection 50 in an inner offset relation with respect to the hinge connections 58 and 59, each segment is pivotally movable only through 90°. This movement is more clearly illustrated in FIGS. 5 and 6, wherein segment 34 is shown having been moved relative to segment 38 from the aligned position in FIG. 5 to the generally perpendicular position in FIG. 6. As the segment 34 moves from the aligned to the perpendicular position, the spring arm 46 and the connecting arm 48 that are pivotally connected along the hinge connection 50 move to an over-center position and are forced outwardly as illustrated in FIG. 6 to locate the segment 34 in perpendicular relation with respect to the segments 38. It is understood that all of the segments are movable in this manner for location of the arm members in a variety of positions in accordance with the desires of the user.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A doll construction comprising a relatively flexible body to which leg members and arms are joined, an arm assembly located in said body adjacent to the upper end thereof and extending outwardly of the body into said arms to define therewith arm members, said arm assembly being defined by an elongated strap formed separately from said body and arms of a relatively rigid plastic material and including a plurality of spaced, hingedly connected segments that are selectively pivotal to locate the arm members in a variety of stable positions from fully open to fully closed, said strap having reduced portions formed along the length thereof that extend transverse to the longitudinal axis of said strap and that define hinge connections for separating said strap into the spaced segments, and a plurality of spring arms integrally formed on said strap and being selectively and hingedly movable to locate a said segment in a selected stable position.

2. A doll construction as claimed in claim 1, a hinge connection connecting each of said spring arms to a connecting arm and being offset with respect to the hinge axis of the associated segment, wherein pivotal movement of a segment is produced by an over-center movement of the associated spring arm and connecting arm.

3. A doll construction as claimed in claim 1, a projection formed on said strap intermediate the ends thereof and defining a support on which a head of said doll is mounted.

4. A doll construction as claimed in claim 1, a flexible cover which includes said body, leg members and arms receiving said arm assembly therein, wherein the segments of said arm assembly are movable with the portion of the flexible cover in which the arm assembly is mounted for effecting a movement of the arm members to the various positions thereof.

5. A doll construction as claimed in claim 4, said segments being arranged such that in the fully open position of said arm assembly the segments are substantially coplanar, and in the fully closed position each segment is located in generally perpendicular relation with respect to an adjacent segment.

6. A doll construction as claimed in claim 5, said arm assembly as defined by said segments being formed in a unitary one-piece construction formed of a plastic material.

7. A doll construction as claimed in claim 6, said segments being defined by a plurality of longitudinally spaced, laterally extending hinge connections that are reduced in thickness relative to the normal thickness of said one-piece plastic arm assembly, wherein said segments are pivotally movable about said hinge connections.

* * * * *